US006302583B1

(12) United States Patent
Steinmetz

(10) Patent No.: US 6,302,583 B1
(45) Date of Patent: Oct. 16, 2001

(54) METHOD AND APPARATUS FOR FILLING TRASH BAGS

(76) Inventor: Floyd Steinmetz, R.R. 4, Box 4199, Moscow, PA (US) 18444

( * ) Notice: Subject to any disclaimer, the term of this patent is extended or adjusted under 35 U.S.C. 154(b) by 0 days.

(21) Appl. No.: 09/584,944

(22) Filed: Jun. 1, 2000

Related U.S. Application Data

(63) Continuation of application No. 09/224,581, filed on Dec. 31, 1998, now Pat. No. 6,129,207, which is a continuation-in-part of application No. 08/890,737, filed on Jul. 11, 1997, now Pat. No. 5,884,454, which is a division of application No. 08/708,127, filed on Apr. 5, 1996, now Pat. No. 5,743,651.

(51) Int. Cl.[7] ..... B65D 33/02
(52) U.S. Cl. ..... 383/33; 248/99
(58) Field of Search ..... 206/408, 554; 248/99, 100; 294/1.1, 1.3; 383/33, 34, 34.1, 75, 76

(56) References Cited

U.S. PATENT DOCUMENTS

| | | | | |
|---|---|---|---|---|
| 2,551,044 | * | 5/1951 | Ottinger et al. | 383/76 |
| 3,653,583 | * | 4/1972 | Meyer | 383/75 |
| 4,106,734 | * | 8/1978 | Walitalo | 248/100 |
| 5,092,681 | * | 3/1992 | Ashley, III | 383/76 |
| 5,116,138 | * | 5/1992 | Macsenti et al. | 248/99 |
| 5,135,222 | * | 8/1992 | Spector | 383/76 |
| 5,451,107 | * | 9/1995 | Ricker | 383/34 |

* cited by examiner

*Primary Examiner*—Jim Foster
(74) *Attorney, Agent, or Firm*—John F. A. Earley; John F. A. Earley, III; Harding, Earley, Follmer & Frailey

(57) ABSTRACT

A package for a trash bag rod which is flexible and resilient for opening a trash bag and for forming a hoop shape for holding the trash bag open while it is being filled with fallen leaves, lawn clippings, and other trash, comprises a trash bag rod which is normally straight but which is wound into a coil that springs back toward straight position when released from the coil, an enclosure holding the trash bag rod in coiled position with at least one end portion of the rod being held in straight position to form a straight end portion of the rod within the enclosure, whereby after the coiled rod is released from the enclosure the straight end portion is more easily threaded through a perimeter portion of the open end of a trash bag than a rod with a curved end portion. The method includes preforming a series of openings around the top perimeter portion of the trash bag. The flexible resilient rod may have a cross section with a barbell configuration with two balls being joined together by a web which is thinner than the balls with a resulting savings in material by comparison with a rod which is round or rectangular in cross section.

7 Claims, 4 Drawing Sheets

METHOD AND APPARATUS FOR FILLING TRASH BAGS

CROSS REFERENCES TO RELATED APPLICATIONS

This is a continuation of application Ser. No. 09/224,581 filed on Dec. 31, 1998, U.S. Pat. No. 6,129,207, which is a continuation-in-part application of U.S. patent application Ser. No. 08/890,737 filed Jul. 11, 1997, now U.S. Pat. No. 5,884,454 which is a divisional patent application of U.S. patent application Ser. No. 08/708,127, filed Apr. 5, 1996, now U.S. Pat. No. 5,743,651 issued Apr. 28, 1998.

BACKGROUND OF THE INVENTION

1. Field of the Invention

This invention relates to doing yard work around the house and more particularly concerns a method and apparatus for collecting fallen leaves, lawn clippings, and trash when doing yard work and inserting such material into a trash bag which is fully open without anyone being required to stand there and hold it open. This invention also relates to a package for a trash bag rod or strap for holding the trash bag open, and a trash bag with a series of preformed holes for receiving the strap.

2. Description of the Prior Art

Anyone who has done yard work around their home is familiar with plastic trash bags. These are generally made from film ranging from 0.5 to 1.2 mil thickness. The common types available differ somewhat in diameter and length but not by much. They are advertised as fitting into garbage cans up to thirty gallons, or thirty-three gallons, or thirty-nine gallons.

These bags are very handy and economical. The problem arises when it comes to filling them. An accepted technique is to place the open bag into a metal or plastic garbage can and fold the lip of the bag over the top edge of the can. This assumes that a can is available, the can is empty, and it is the correct shape to suit the bag.

Under ideal conditions, the bag in the can accepts leaves, grass clippings, pine needles, or whatever, without falling into the can with the trash. Once the bag is full, it must be lifted from the can. According to U.S. Pat. No. 4,558,463 which issued on Dec. 10, 1985 to Boyd, "The load in a trash bag may typically be as high as 30–50 lbs." Column 1, lines 21–22.

To lift that weight is in itself not easy, but to add to the difficulty the lower portion of the bag is swelling and gripping the can like a cork in a bottle. Now the can must be held down while the full bag is drawn out.

To fill a trash bag without using a can as an assist is also very difficult. It is almost impossible to lay a bag on the ground and arrange the opening to anywhere near its full extent. Bags having a hem top edge with a drawstring are somewhat better in this regard than bags with a simple sheared edge, but even the hemmed bags leave much to be desired.

SUMMARY OF THE INVENTION

My inventive method and apparatus is intended to alleviate the above problems. It includes a reusable flexible resilient rod or strap which is placed into the top edge of a plastic bag at its open end. As the rod tries to straighten out, it stretches the bag opening into a circle which is approximately the maximum opening possible. When the bag is on the ground, and is wide open, an arm load of trash may be placed within this circle. The rod and the bag edge are then gripped on opposite sides and lifted. The trash drops to the bottom and the bag is ready for the next arm load of trash. When the bag is full, the rod is slipped out to be used again, and the bag is closed.

The rod may be made from one of many materials such a metal, plastic, or even wood. Synthetic resin plastic is probably the most economical since it may be extruded. There are many types of acceptable thermoplastic material from which to choose, for example, a polyethylene material.

The size in cross section of the rod and the stiffness of the rod may affect the ease of weaving the rod into the edge portion of the trash bag. A TEFLON plastic, a round cross section of about three sixteenth inch diameter works well.

A flexible resilient rod or strap having a cross section with a barbell configuration with two balls being joined together by a web which is thinner than the balls results in savings in material by comparison with a rod which is round or rectangular in cross section.

The length of the rod is not all that critical. It is convenient if the end portions of the rod overlap somewhat outside the bag when the rod is installed in the bag. This provides an end portion which may be gripped to pull the rod out of the bag once the bag is full. Since common sizes of trash bags are five feet or five and one half feet in circumference, a six foot rod length is convenient. However, longer or shorter is acceptable. The rod is helpful in filling the trash bags even if the rod is a little shorter than the bag circumference.

The rod ends may be cut off square to the length. However, cutting the ends of the rod on a bias to form a pointed end is a little more helpful when weaving the rod into the bag, and is the preferred embodiment.

There are two basic types of bag. Those with a drawstring have a hem with cutouts on opposite sides of the hem to give access to the drawstring. It is very convenient to slip the rod into a cutout and push it through the hem. However, the rod travels only 90 degrees around the bag because these bags have a vertical seam on both sides which runs from the bottom to the top of the bag. There are three ways to get the rod past the seam, and they are as follows.

First, you may insert the front end portion of the rod through a cutout into the interior of the hem and pierce the hem wall by pushing the rod from inside of the hem through the outside wall of the hem just before the seam, and return the rod into the inside of the hem just past the seam by piercing the outside hem wall with the rod from outside the hem. This procedure is repeated for the second seam and the rod travels inside the hem until the rod exits through the cutout where it first entered.

Second, using a knife, you may slit the top of the hem for an inch plus/minus on both sides of the seams. The rod is then easily passed out one slit, over the seam, and then returned through the next slit.

Third, using scissors, cut away the top edge of the hem for about an inch on both sides of the seam. This is by far the most convenient passage for the rod out of one slot, pass over the seam, and return through the next slot to the inside of the hem. Bag manufacturers may provide this cutout at the same time the drawstring cutout is made.

The remaining types of trash bags have various closure techniques. However, they have the common feature of having no hem. Therefore, to install a rod, it is necessary to pierce the bag wall with the end of the rod. This is done with an in and out weaving action all along the bag circumference. Location of the rod from the bag top edge and the spacing of the pierced holes are not critical. The rod may preferably be one to three inches below the bag edge, and the pierced holes may be six to eight inches apart.

A series of openings around the top perimeter of the trash bag may be preformed by the manufacturer so as to make it unnecessary for the bag user to pierce holes in the bag with the end of the rod.

A package is provided for the trash bag rod which holds the rod in a coiled position but with both ends of the rod held in straight position so that when the coiled rod is released from the package the rod straight end portion is more easily threaded through the perimeter edge portion of a trash bag than a rod with a curved end portion.

DETAILED DESCRIPTION OF THE DRAWINGS

Figure 1:
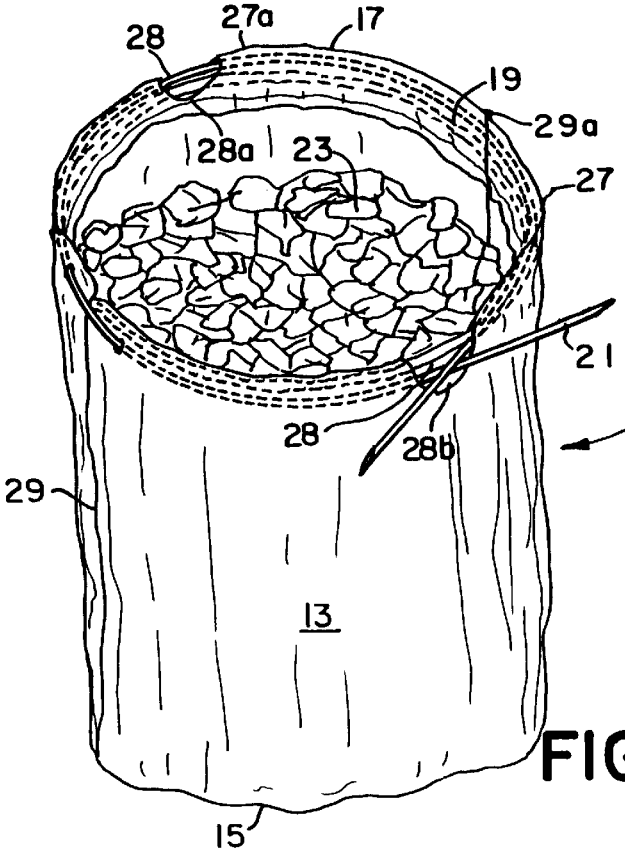
FIG. 1 is a view in perspective of bag apparatus constructed in accordance with this invention and shows a bag with its top end held fully open by a resilient rod and with the bag being partly filled with leaves.

Turning now to the drawings, there is shown a trash bag 11 which has a body portion 13, a bottom portion 15 which is closed, and a top end portion 17 which is open and has a top perimeter portion 19. An opener rod 21 which is flexible and resilient is provide for opening and holding open the open end 17 of the trash bag while it is being filled with trash material such as fallen leaves, lawn clippings, and other trash. The flexible resilient rod 21 is inserted through the top perimeter portion 19 of the trash bag 11 for expanding the top perimeter portion 19 to make it circular and for holding the top perimeter portion 19 in circular position so that the bag 11 is fully open to receive such trash material without requiring anyone to hold the bag open.

Figure 2C:
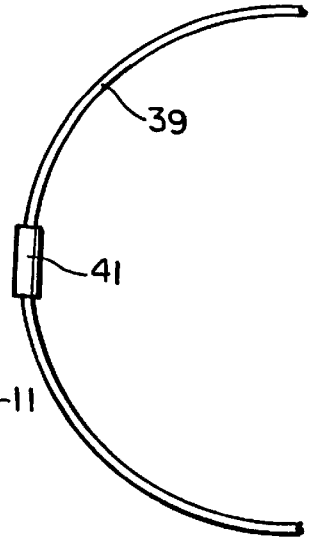
FIG. 2*c* is a view of a rod being made into a circular shape.
Figure 2A:
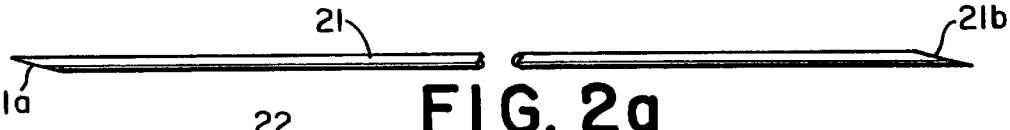
FIG. 2*a* is a view of a rod having tapered ends which is the preferred embodiment of rod.
Figure 2B:
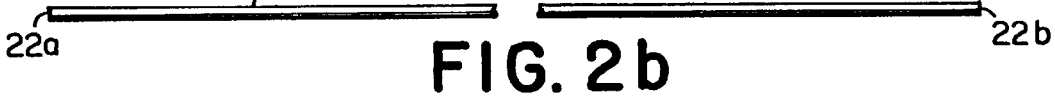
FIG. 2*b* is a view of a rod having square ends.

The rod 21 is shown in FIG. 2*a* and is provided with pointed or tapered ends 21*a* and 21*b* for easier insertion of the rod through the top perimeter portion 19. However, a flexible resilient rod 22 having square ends 22*a* and 22*b* may be used in the practice of this invention if desired.

The method of collecting trash material such as fallen leaves, lawn clippings, and other trash when doing yard work comprises the steps of taking a trash bag 11 having body portion 13, a closed end bottom portion 15, and an open end top portion 17 with a top perimeter portion 19, inserting the flexible resilient rod 21 through the top perimeter portion 19 to expand the top perimeter portion 19 into a circular position and fully open the top perimeter portion 19 of the bag 11, holding the perimeter portion 19 of the bag 11 fully open in circular position by leaving the flexible resilient rod 21 in the top perimeter portion 19, placing the bag on the ground with the fully opened top perimeter portion 19 facing up, placing an arm load of fallen leaves, lawn clippings, or other trash into the fully open top perimeter portion 19, gripping the rod 21 and the top perimeter portion 19 on opposite sides of the bag and lifting them above the level of the load of leaves, lawn clippings, or other trash, so that said trash material drops to the bottom of the bag 11 to ready the bag for the next load of trash, filling the bag 11 with said trash by repeating the placing step and the gripping step until the bag 11 is filled, slipping the rod 21 out of the top perimeter portion 19 to be used again, and closing the top portion 17 of the bag by pulling the drawstrings 28 at drawstring openings 28*a*, 28*b*.

As shown in FIG. 1, the rod 21 is longer than the top perimeter portion 19 of the bag 11, and the rod 21 is inserted through top perimeter portion 19 so that the ends 21*a*, 21*b* of the rod 21 emerge from drawstring opening 28*b* and overlap outside the top perimeter portion 19. The rod 21 is slipped out of the top perimeter portion 19 by grasping one end of the rod 21 and pulling on it.

The rod 21 may be used with a number of different bags. Bag 11 is provided with a hem 27 and drawstrings 28 having two drawstring openings 28*a*, 28*b* about 180 degrees apart.

After the rod 21 has been removed from the bag, the drawstrings 28 are pulled to close the top of the bag.

Bag 11 has vertical seams 29, 29*a* which extend from the top 17 of the bag to bottom 15, and a hem 27. The rod 21 is inserted through the hem 27 and avoids the seams 29, 29*a* by piercing the outer skin of the bag before and after the seam, pushing outwardly through the outer hem wall before the seams 29, 29*a* and pushing inwardly through the outer hem wall into the hem 27 after passing the seams 29, 29*a*.

Figure 3A:
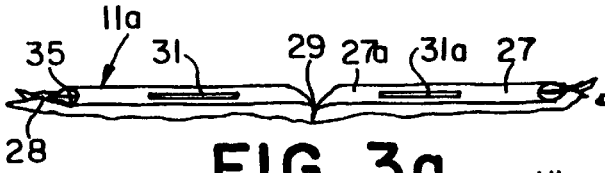
FIG. 3*a* is a partial view in top plan of a portion of a perimeter of a bag and shows slits in the top fold line of the bag before and after a vertical seam.

FIG. 3*a* is a partial view in top plan and shows a similar bag 11*a* having a hem 27 with a tunnel 35 and a drawstring 28, but instead of piercing the side wall of the hem 27 with the rod 21, the bag 11*a* is provided with a slit 31 in the top fold line 27*a* of the hem 27 just before the vertical seam 29, and a slit 31*a* just after the vertical seam 29.

Figure 3B:
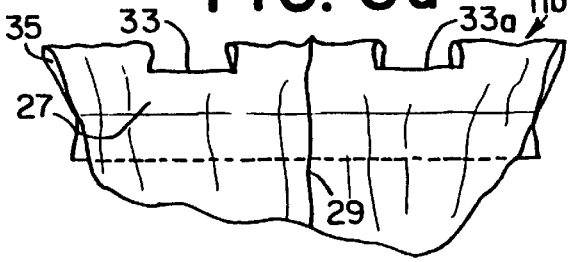
FIG. 3*b* shows a partial view in elevation of the top of a bag having cut out portions or slots cut into the top perimeter of the bag before and after a vertical seam.

FIG. 3*b* shows an alternative bag 11*b* with a hem 27 and is provided with a cutout portion 33 in the top of the hem 27 just before the vertical seam 29, and a cutout portion 33*a* just after the vertical seam 29 in the hem 27. In this embodiment of the invention, the rod 21 passes through the tunnel 35 of hem 27 and out of the hem through the cutout portion 33 and returns to the tunnel 35 of the hem 27 after passing the vertical seam 29 through cutout portion 33*a* of hem 27.

Figure 3C:
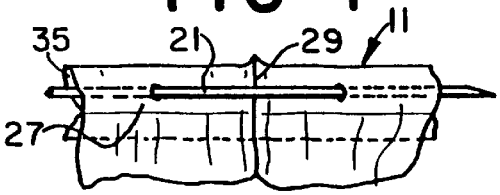
FIG. 3*c* is a partial view in elevation of a bag having a rod which is piercing a hole in the outside wall of a hem both before and after a vertical seam, with the drawstring being omitted for clarity.
Figure 5:
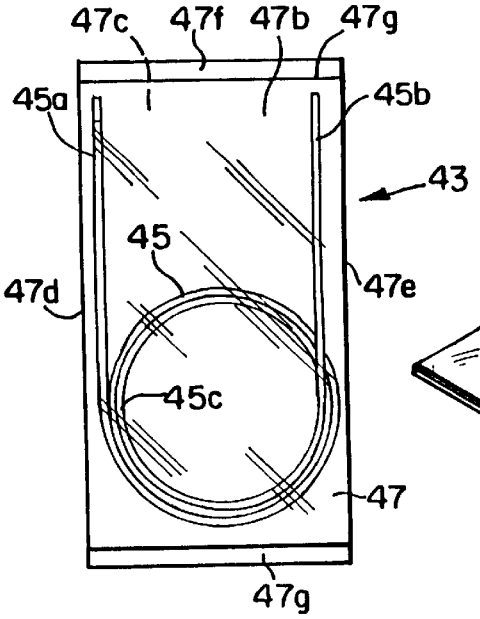
FIG. 5 is a top plan view of a package for a trash bag strap and shows a clear plastic bag suitable for holding and displaying a colored strap.
Figure 6:
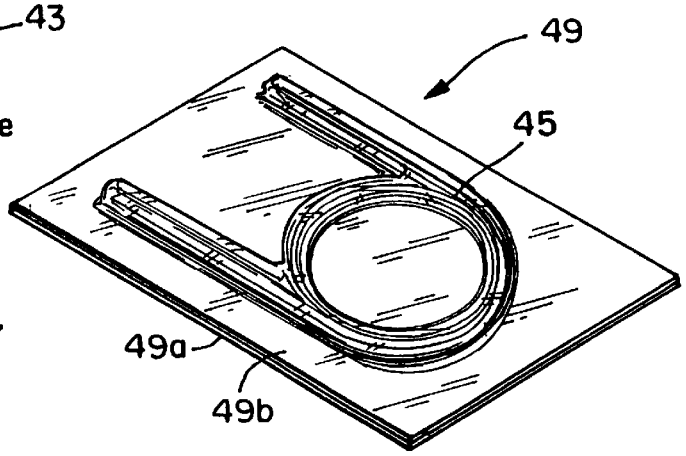
FIG. 6 is a view in prospective of a package for a trash bag strap and shows a blister pack.
Figure 7:
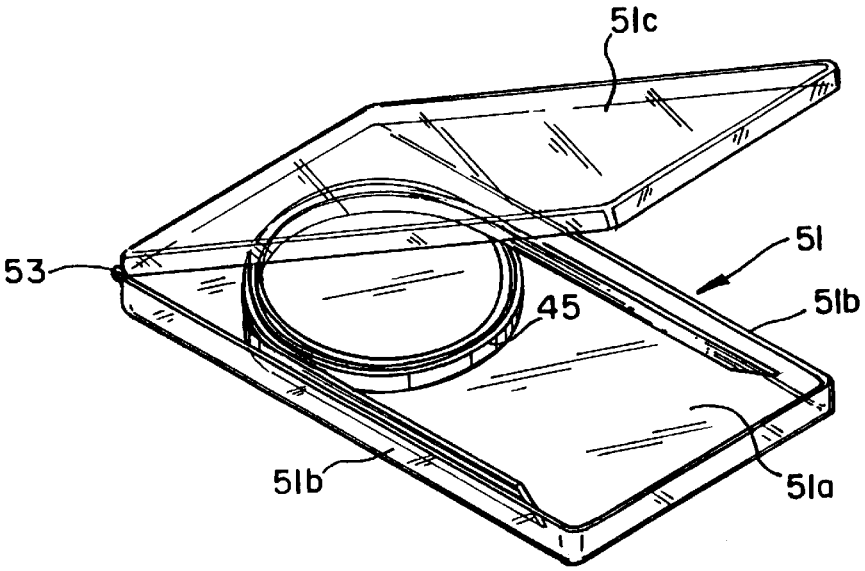
FIG. 7 is a view in perspective of a strap package showing a clam shell pack.
Figure 8A:
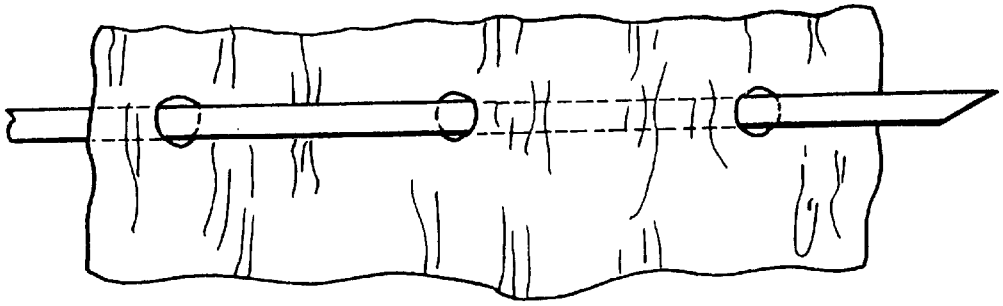
FIG. 8*a* is a partial view in elevation of the top perimeter portion of a hemless trash bag and shows a series of circular-preformed openings which are preformed in manufacturing the trash bag so that the user of the trash bag does not have to punch openings in the trash bag with the trash bag strap but just inserts the trash bag strap through the preformed openings.
Figure 8B:
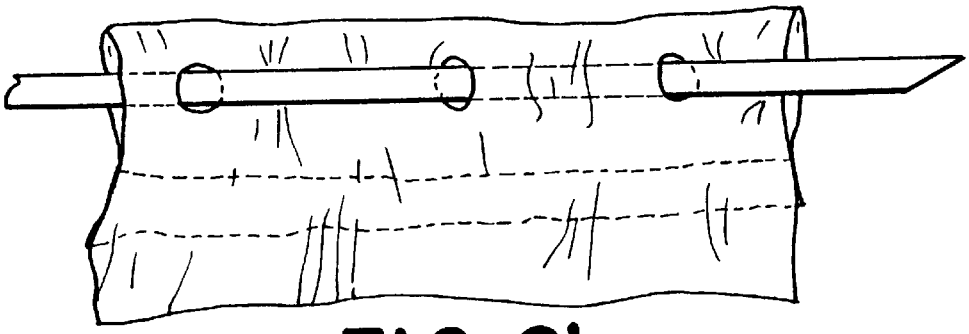
FIG. 8*b* is a partial view in elevation of the top perimeter portion of a hemmed trash bag and shows a series of circular preformed openings which are preformed in manufacturing the trash bag so that the user of the trash bag does not have to punch openings in the trash bag with the trash bag strap but just inserts the trash bag strap through the preformed openings.
Figure 8C:
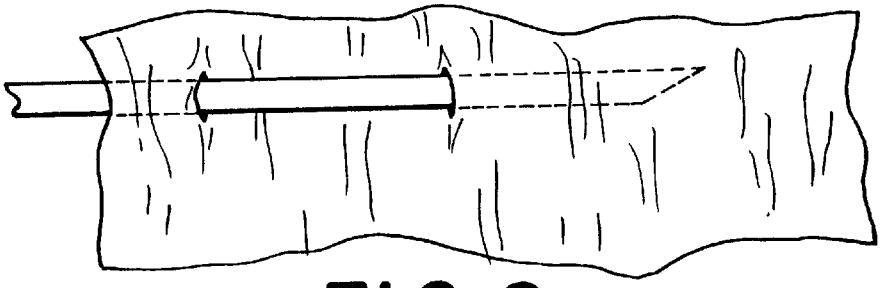
FIG. 8*c* is a partial view in elevation of the top perimeter portion of a trash bag and shows a series of preformed openings which are in the form of a vertical slit.
Figure 8D:
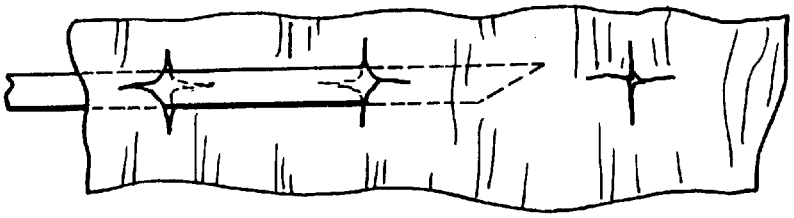
FIG. 8*d* is a partial view in elevation of the top perimeter portion of a trash bag and shows a series of preformed openings which are in the form of a plus sign with a vertical slit crossing a horizontal slit.
Figure 8E:
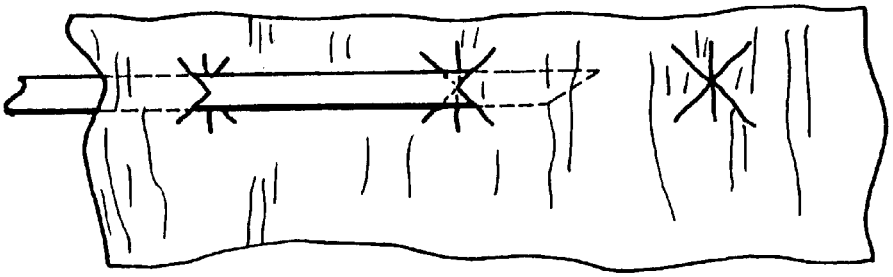
FIG. 8*e* is a partial view in elevation of the top perimeter portion of a trash bag and shows a series of preformed openings which are in the form of an asterisk.
Figure 8F:
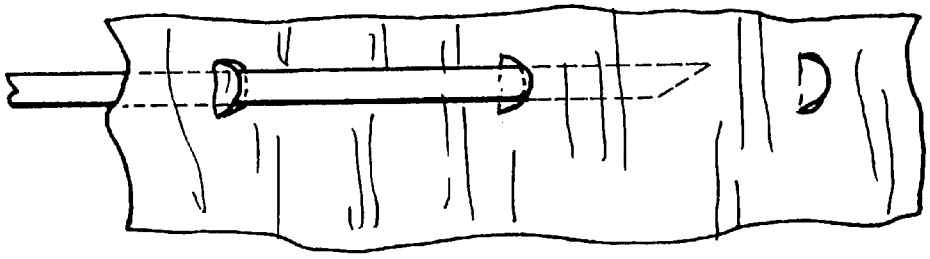
FIG. 8*f* is a partial view in elevation of the top perimeter portion of a trash bag and shows a series of preformed openings in the form of a tab.

FIG. 3*c* is an enlarged partial view of bag 11 showing the rod 21 as it passes through the hem 27 around the vertical seam 29. In the view of FIG. 3*c*, the drawstring 28 has been omitted for the sake of clarity.

Figure 4:
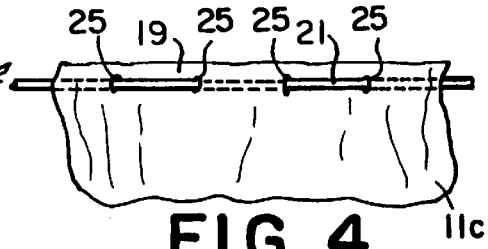
FIG. 4 is a partial view in elevation of a bag without a hem and without drawstrings and shows a rod which has pierced the top portion of a bag in and out in a weaving fashion.

FIG. 4 shows an enlarged partial view of another bag 11*c* which has no hem and shows the piercing of holes 25 around the top perimeter portion 19 of the bag 11*c* with an in and out weaving action to attach the rod 21 to the top perimeter portion 19.

The original rod 21 used in this invention was a 3/16 inch diameter rod of very flexible TEFLON synthetic resin.

TEFLON is a trademark of E.I. Dupont de Numours & Co., 1007 Market Street, Wilmington, Del. 19898 for its synthetic resinous fluorine, containing polymers in the form of molding and extruding compositions, fabricated shapes: namely, sheets, rods, tubes, tape and filaments; solutions; and emulsions.

The original TEFLON rod 21 performed well in all respects. However, I thought it might feel better to the workman in picking up the bag edge with the rod 21 woven therein if the rod were just a little thicker. Therefore, I obtained rods of ¼ inch diameter in the following thermoplastic materials. These are listed in order of decreasing hardness which also denotes decreasing stiffness: Polycarbonate, Nylon, Delrin, PVC Type I, ABS, High Density Polyethylene, High Impact Polystyrene, Polypropylene, Low Density Polyethylene.

Surprisingly, I very quickly learned that none of these rods could be used as received. The ¼ inch diameter nylon rod was almost impossible to weave into the edge of a trash bag. When it was finally accomplished, it formed a bag opening which had a narrow tear drop shape instead of the desired fully open circular shape.

The low density polyethylene rod was much easier to weave into the bag, but it also created a tear drop shaped opening, which was somewhat wider than the bag with the nylon rod, but still nowhere near a circular shape.

In my opinion, there are two reasons for the difference of the behavior of the ¼ inch rods as compared to the behavior of the original 3/16 inch diameter TEFLON rod.

First, material stiffness.

Second, thickness of the rod. Changing from 3/16 inch diameter to ¼ inch diameter does not appear to be too great a change. However, the result was that the ¼ inch rod was almost impossible to weave into the edge portion of the trash bag, and when it formed the bag opening, the bag opening was a narrow tear drop shape instead of the desired fully opened circular shape. This result was surprising.

A possible explanation of why this surprising result occurs might be as follows. The deflection of a beam in bending is a function of the Moment of Inertia (I) of the beam cross section. In the present invention, the cross sections are circular, and the Moment of Inertia (I)=0.049 times diameter to the fourth power. Therefore:

For 3/16 diameter I=0.000061

For ¼ diameter I=0.000191

Or a ¼ diameter rod is 3.13 times stiffer than a 3/16 inch diameter rod.

In conclusion, none of the ¼ diameter rods function properly when in straight rod form. However, when thermoformed into circular shape, the ¼ inch diameter rods worked very well. To do this, I formed a ¼ inch rod into a circle by inserting the ends of a ¼ inch rod 39 into a metal tube 41 which retained the circular shape, and heated the rod 39 and tube 41 in an oven at about 235 degrees Fahrenheit for about two hours. Tube 41 was a six inches long tube made of copper with an inside diameter of ½ inch.

The rod 39 was preformed into a circle of a diameter approximately equal to the diameter of the opening of an average trash bag.

Turning now to the embodiments of the invention shown in FIGS. 5 through 9, there is shown a package 43 for a trash bag strap or rod 45 which is flexible and resilient for opening a trash bag 11 and for forming a hoop shape for holding the bag 11 open while it is being filled with fallen leaves, lawn clippings, and other trash. The rod package 43 comprises a trash bag rod 45 which is flexible and resilient and has two end portions 45*a* and 45*b*. The rod 45 is made of a synthetic resin plastic and is normally straight. However, in the package 43, the rod 45 is wound into a coil 45*c* which springs back towards straight position when it is released from the coil. An enclosure or bag 47, is made of clear plastic and holds the trash bag rod 45 in the coiled position. At least one end portion 45*a*, 45*b*, and preferably both end portions 45*a*, 45*b* of the rod 45, is held in a straight position to form straight end portions of the coil within the enclosure or bag 47. Accordingly, after the coiled rod 45 is released from the bag 47 the rod straight end portions 45*a*, 45*b* are more easily threaded through a perimeter edge portion of the bag 47 than a rod which has a curved end portion.

The enclosure or bag 47 is made of a clear plastic material and has an upper panel 47*b* joined to a lower panel 47*c* by side walls 47*d* and 47*e* and by top seal 47*f* and bottom seal 47*g*. The two straight end portions 45*a* and 45*b* of the rod 45 are held in place by the bag 47, and the remainder of the rod 45 is held coiled by the bag 47.

Instead of being held in coiled position by a bag 47, the strap 45 may be held in coiled position by a blister pack 49 having a base 49*a* made of stiff paper board or cardboard, and a clear plastic cover sheet 49*b* which may be shrink wrapped onto the coiled rod 45 and onto the base 49*a*.

In another embodiment, the enclosure for the coiled rod 45 may be a clam shell pack 51 having a base portion 51*a*, side walls 51*b* which hold the rod 45 in coiled position, and a lid portion 51*c* connected to the clam shell base portion 51*a* by a hinge 53.

Instead of the user punching holes in the perimeter portion of a trash bag, a series of holes may be preformed in the perimeter portion of the trash bag by the manufacturer of the bag. With a trash bag having a series of preformed holes in the perimeter portion, a method of collecting fallen leaves, lawn clippings, and trash when doing yard work, comprises the steps of taking a trash bag having a body portion, a closed end portion, and an open end portion with a top perimeter portion, preforming a series of openings around the top perimeter portion of the trash bag, inserting one end of a flexible resilient rod through the top perimeter portion of the trash bag by weaving the rod through the preformed openings to expand the top perimeter portion into a hoop-like circular position and fully open the top perimeter portion of the bag, holding the top perimeter portion of the bag fully opened in circular position by leaving the flexible resilient rod in the top perimeter portion, placing the bag on the ground with the fully opened top perimeter portion facing up, dropping an arm load of fallen leaves, lawn clippings, or other trash into the fully opened top perimeter portion without anyone holding the bag opened, gripping the rod and the top perimeter portion of the bag on opposite sides and lifting them above the top level of the load of leaves, lawn clippings or other trash so that the leaves, lawn clippings, or other trash drop to the bottom of the bag to ready the bag for the next load of trash, filling the bag with the trash by repeating said dropping step and said gripping step until the bag is filled, and slipping the rod out of the top perimeter portion to be used again with other bags.

Figure 9:
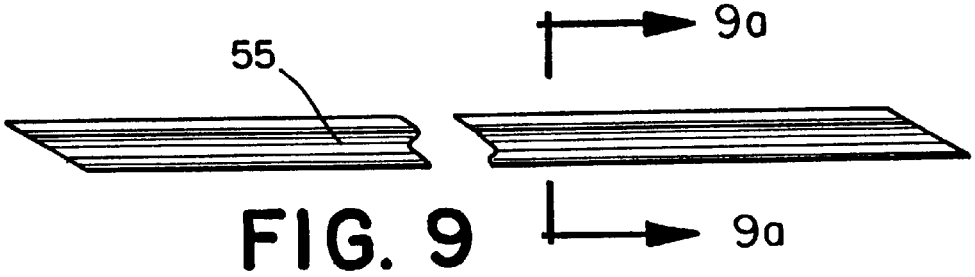
FIG. 9 is a side view of a trash bag strap or rod in the form of a barbell in cross section.
Figure 9A:
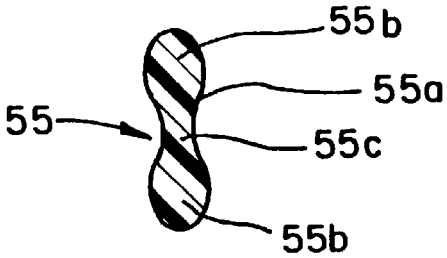
FIG. 9*a* is a view in cross section of the strap of FIG. 9.

A preferred embodiment of my rod or strap 55 is shown in FIGS. 9, 9*a,* and is formed from a synthetic resin plastic and has a cross section 55*a* with a barbell configuration with two balls 55*b* being joined together by a web 55*c* that is thinner then the balls 55*b* with a result in savings in material by comparison with a rod which is round or rectangular in cross section.

The method of collecting fallen leaves, lawn clippings, and trash when doing yard work may include the steps of taking a trash bag having a body portion, a closed end portion, and an open end portion with a top perimeter portion, preforming a series of openings around the top perimeter portion of the bag, forming a flexible resilient rod into a coil with the end portions being straight, inserting said coiled rod into an enclosure to hold it in said coiled position, removing said coiled rod from the enclosure and causing the rod to spring back towards straight position, and inserting one end of the flexible resilient rod into the top perimeter portion of the bag by weaving one end of the rod through the preformed openings to expand the top perimeter portion into a circular hoop-like position and fully open the top perimeter portion of the bag.

The preformed openings of the trash bag may be in the form of circular holes. However, in forming the trash bag, the circular holes would leave circular blanks which would have to be discarded by the trash bag manufacturer. To avoid this, the preformed openings in the perimeter portion of the bag may be in the form of tabs. Other shapes for the preformed openings are in the form of slits, or in the form of multiple slits forming a cross, or forming an asterisk shape.

A trash bag having a hem in the top perimeter portion of the bag and having a vertical seam in the hem is provided with a pair of preformed openings positioned before and after the seam to permit the rod to bypass the seam and pass through the hem.

Discussion

I have attacked the subject of the trash bag hoop invention from various directions, i.e., the rod which forms the hoop, the method of filling the bag, packaging the rod, and the trash bag itself manufactured with preformed holes or slits designed to receive the hoop rod. Such preformed holes or slits certainly make it more convenient and faster for the user to install the rod into the trash bag.

In column 2 of my U.S. Pat. No. 5,743,651, I describe means for the user to install the rod in bags with hems (draw string type of bag), and in bags with a plain sheared edge. Instead of the user making the holes in the bag, for example, in the case of plain edge bags, the manufacturer may punch a series of appropriately spaced holes in the trash bag to receive the rod. These holes may be of any shape. They also may not be complete holes, i.e., they may remain attached at one point or edge to form a flap. This latter method solves the manufacturer's problem of dealing with millions of small punched blanks formed if he punched circular holes in the trash bag. Another technique for preforming openings in the trash bags is to provide small slits at the appropriate places. These may be a single slit or multiple slits forming a cross or asterisk configuration. With the hem bags, the manufacturer preforms holes, slits, or notches to allow the rod to pass the seams as described in my U.S. Pat. No. 5,743,651.

It is to be noted that the package of this invention provides straight end portions for the trash bag strap for easy insertion of the strap into the openings in the trash bag perimeter.

In designing packaging for the retail trade, there are various factors to be considered. These include appearance, cost, size, protection, etc.

In the case of the trash bag strap, the size of the trash bag strap package presents a challenge. The strap or rod is in the neighborhood of 72 inches in length. Accordingly, it is not practical to package this as a straight, long part. Since the rod is flexible, I provide a solution to the packaging problem by winding it into a small coil and anchoring the end with tape, wire tie, string, etc. This makes a neat item which may be slipped into a transparent package and sealed. The package may be from 4 to 8 inches in diameter.

However, a problem arises if the strap is kept in coiled condition for any length of time. The strap is made of extruded synthetic resin plastic which takes a "set" when restrained in the coiled position for a very long period of time. That is, it only partially returns to a straight condition when released. The longer time that it is held in the coil, the greater the curvature when released. A retail item such as this might be in its package for months before it is purchased and used.

This curvature is of little or no consequence in the center areas of the strap, but it does pose a problem at the ends of the strap. Since the strap is attached by a weaving action to trash bags having no hem and no draw strings, the curved end makes the weaving awkward either on the inward or on the outward piercing movement.

For example, if the end of the strap is held with a curvature towards the bag on the first piercing inward through the bag, then it is curved the wrong way for the next outward piercing of the bag.

In the case of those trash bags having draw strings, the strap must be pushed or fed through the hem of the bag. Curvature of the strap end causes resistance, particularly since the end has a point.

An object of my package design is to allow the ends of the strap to remain straight while the center section is coiled. The length of the straight ends may be varied as desired by adjusting the width of the package and/or the number of coils in the center section of the strap.

In the following examples, the strap is ⅛ of an inch thick and has a length of 72 inches.

With 3½ inch coils and 6 inch package width, the straight length of the ends of the strap is about 5½ inches.

With 3½ inch coils and 6⅝ inch package width, the straight lengths of the ends of the strap is about 3 inches.

With 2½ inch coils and 8 inch package width, the straight lengths of the ends is about 6 inches.

For the greatest ease of insertion of the strap into a trash bag, the ends of the strap are straight for at least 3 to 6 inches with a preference towards the higher number. From a technical stand point, only one end of the strap needs to be straight. However, to eliminate fumbling by the user, it is best to create straight lengths on both ends of the strap. The type of package may be, for example, a simple flat bag, a clam shell package, or a blister type package. The final configuration is a compromise between desired straight length, available store space for display, required package surface area for printed instructions, and cost.

The strap with the barbell cross section saves material over the strap with a round or rectangular cross section and yet maintains its stiffness. Moreover, it looks special and more important, as well as saving a substantial percentage of the material costs.

Since most trash bags are a dark green or black in color, I find it preferable to make the straps in a white color or in an orange color.

What is claimed is:

1. A trash bag assembly for doing yard work for opening and holding open the open end of the trash bag while it is being filled with fallen leaves, lawn clippings, and other trash, comprising a bag for doing yard work having a body portion, a closed end bottom, and an open end top portion with a top perimeter portion, and means for opening the trash bag by expanding the top perimeter portion to a circular hoop-like position and for holding the top perimeter in circular hoop-like position so that the bag is fully open to receive fallen leaves, lawn clippings, and other trash without requiring someone to hold the bag open, said means for opening the trash bag and holding it open being insertable into the bag after manufacture of the trash bag, said means being a flexible resilient rod insertable into and removable from the trash bag, and said means being reusable on other trash bags indefinitely, said rod having two ends which are free and unattached and not attached to each other so that either end of the rod can be inserted into the trash bag and the rod can be removed from the trash bag by pulling on either end, said rod having a cross section with a barbell configuration with two bulbs being joined together by a web which is thinner than the bulbs with a result in savings in material by comparison with a rod which is round in cross section.

2. The trash bag assembly of claim 1 for doing yard work adapted to be opened and held opened while it is being filled with fallen leaves, lawn clippings, and other trash, further including a series of preformed openings punched into the bag around the top perimeter portion of the bag adapted to receive a flexible resilient rod which is formed into a hoop shape for holding the trash bag open to receive said trash.

3. The trash bag of claim 2, said openings being in the form of circular holes.

4. The trash bag of claim 1, said openings being in the form of flaps connected to the edge of the openings.

5. The trash bag of claim 1, said openings being in the form of slits so as to avoid making and dropping blanks.

6. The trash bag of claim 1, said openings being in the form of multiple slits forming a cross or asterisk shape so as to avoid making and dropping blanks.

7. The trash bag of claim 2, said trash bag having a hem in the top perimeter portion of the bag, a vertical seam in the hem, with said preformed openings including a pair of preformed openings positioned before and after the seam to permit the rod to bypass the seam and pass through the hem.

* * * * *